US008454381B2

(12) United States Patent
Wu

(10) Patent No.: US 8,454,381 B2
(45) Date of Patent: Jun. 4, 2013

(54) CABLE CONNECTOR HAVING A HOUSING WITH AN ENGAGING PORTION AND A RESTRICTING PORTION ON ITS TOP SURFACE

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 6 days.

(21) Appl. No.: 13/326,343

(22) Filed: Dec. 15, 2011

(65) Prior Publication Data

US 2012/0156900 A1 Jun. 21, 2012

(51) Int. Cl.
*H01R 12/24* (2006.01)

(52) U.S. Cl.
USPC ..... 439/352

(58) Field of Classification Search
USPC ..... 439/352–358
See application file for complete search history.

(56) References Cited

U.S. PATENT DOCUMENTS

| | | | | |
|---|---|---|---|---|
| 6,890,205 | B1 * | 5/2005 | Wu | 439/358 |
| 6,896,540 | B1 * | 5/2005 | Wu | 439/417 |
| 7,261,582 | B2 | 8/2007 | Wu | |
| 7,857,650 | B1 * | 12/2010 | Wu | 439/352 |
| 7,997,909 | B2 * | 8/2011 | Xu et al. | 439/76.1 |

* cited by examiner

*Primary Examiner* — Chandrika Prasad
(74) *Attorney, Agent, or Firm* — Wei Te Chung; Ming Chieh Chang

(57) ABSTRACT

A cable assembly includes a PCB, a rear housing, a front housing assembled with the rear housing and a locking member. The printed circuit board includes a mating end formed with a plurality of first conductive pads and rear end formed with a plurality of second conductive pads. The rear housing is over molded around the rear end of the PCB. The front housing encloses a part of the PCB. The front housing defines a receiving slot and an engaging portion. The locking member is assembled to the engaging portion. The front housing further has two restricting portions extending upwardly from the upper surface thereof, each restricting portion has a supporting portion, an extension portion forwardly extending from a rear end of the supporting portion and spaced from the supporting portion so that a receiving groove is formed between the supporting portion and the extension portion.

9 Claims, 7 Drawing Sheets

CABLE CONNECTOR HAVING A HOUSING WITH AN ENGAGING PORTION AND A RESTRICTING PORTION ON ITS TOP SURFACE

BACKGROUND OF THE INVENTION

1. Field of the Invention

The present invention relates to a cable assembly, and more particularly to a cable assembly used for high-speed signal transmission having balanced supporting ribs.

2. Description of Related Art

U.S. Pat. No. 7,261,582 issued to Jerry Wu on Aug. 28, 2007 discloses a cable assembly. The cable assembly comprises an insulative housing, a printed circuit board retained in the insulative housing, a cable electrically connected to the printed circuit board and a locking member assembled to the insulative housing. The insulative housing has an engaging portion extending upwardly from the middle thereof. The locking member is retained in the engaging portion and comprises a pressing portion. When the cable assembly is to engage/disengage with a complementary connector, a downward pressing force is exerted on the pressing portion of the locking member. During assembly, a shell of the complementary connector is supported by the engaging portion. However, two sides of the shell are not supported and the shell is liable to rotate. Thus, the engagement of the cable assembly and the complementary connector is not reliable.

Hence, an improved cable connector assembly is desired to address the problems stated above.

SUMMARY OF THE INVENTION

An object of the present invention is to provide a cable assembly for mating with a complementary connector more reliably.

To achieve the above object, a cable connector assembly in accordance with the present invention comprises a rear housing piece, a printed circuit board, a rear housing piece, a front housing piece assembled with the rear housing piece and a locking member. The printed circuit board comprises a mating end formed with a plurality of first conductive pads and an opposite rear end formed with a plurality of second conductive pads electrically connecting with conductors of a cable. The rear housing piece over-molded around the rear end of the printed circuit board. The front housing encloses a part of the printed circuit board. The front housing piece defines a receiving slot therethrough to permit the mating end of the printed circuit board running through for electrically connecting with the complementary connector and an engaging portion upwardly protruding from a upper surface thereof. The locking member is assembled to the engaging portion of the front housing piece. The front housing piece further has two restricting portions extending upwardly from the upper surface thereof, each restricting portion has a supporting portion, an extension portion forwardly extending from a rear end of the supporting portion and spaced from the supporting portion so that a receiving groove is formed between the supporting portion and the extension portion.

Other objects, advantages and novel features of the invention will become more apparent from the following detailed description when taken in conjunction with the accompanying drawings.

DETAILED DESCRIPTION OF THE INVENTION

Figure 1:
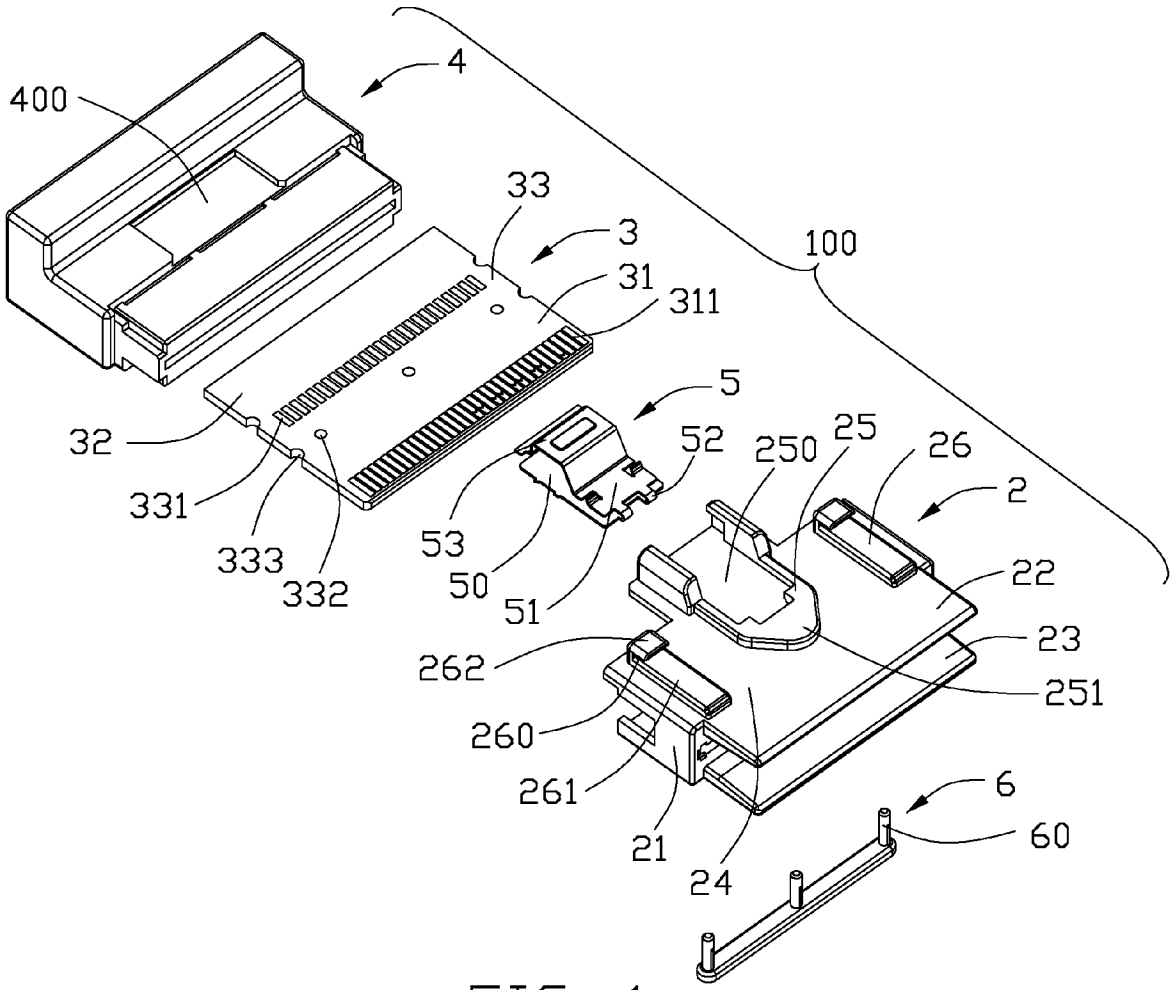
FIG. 1 is an exploded, perspective view of a cable assembly in accordance with the preferred embodiment of the present invention.
Figure 2:
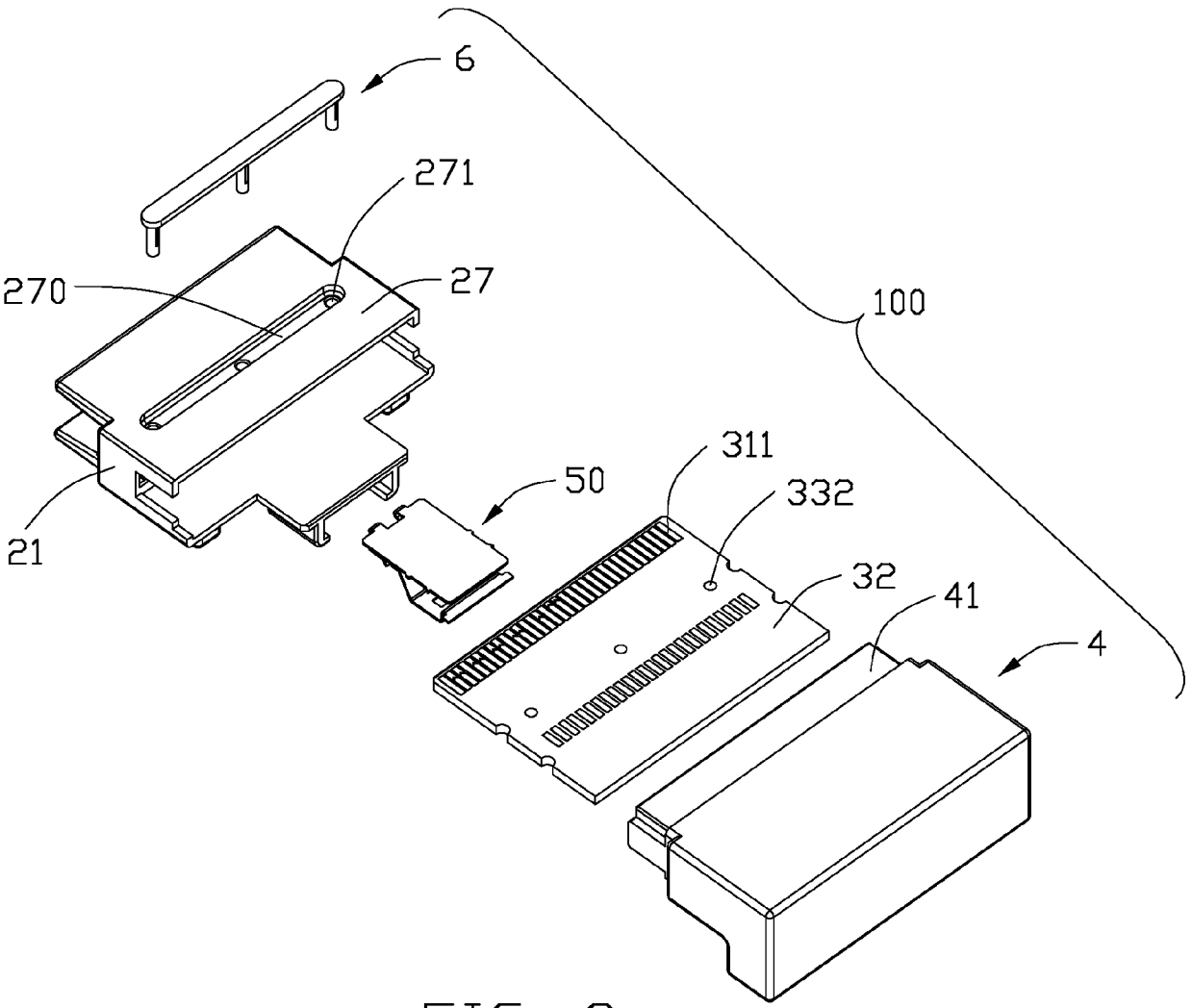
FIG. 2 is a view similar to FIG. 1, but taken from a different aspect.

Referring to FIGS. 1 to 2, a cable connector assembly 100 in accordance with the preferred embodiment of the present invention comprises a front housing piece 2 and a rear housing piece 4 forming a housing member, a printed circuit board 3 retained in the front housing piece 2 and a locking member 5 assembled to the housing member for locking with a complementary connector.

Referring to FIGS. 1-2, the front housing piece 2 comprises a body portion 21, first and second tongue portions 22, 23 respectively extending forwardly from a front face of the body portion 21. The first tongue portion 22 and the second tongue portion 23 are parallel spaced from each other at a specified distance in a vertical direction thereof. The front housing piece 2 defines an upper surface 24 and a lower surface 27 opposite to the upper surface 24. The front housing piece 2 comprises an engaging portion 25 extending from the upper surface 24 and beyond a rear surface thereof. The front housing piece 2 further comprises two restricting portions 26 in two parallel rib form extending forwards from the rear surface towards the front surface at the upper surface 24 and located at two sides thereof. The engaging portion 25 is formed in the middle of the upper surface 24 and located between the two restricting portions 26. The engaging portion 25 defines a front portion with a top or support surface 251 and a groove 250 recessed in the top surface 251 and extending through the rear surface. The restrict portions 26 and the front portions of the engaging portion 250 forward substantially at a same level from the rear surface. Each restricting portion 26 comprises a lower portion 261, an upper portion 262 located above a rear end of the lower portions 261. The upper portion 262 is spaced from the lower portion 261, thereby defining a receiving groove 260 therebetween. The top surfaces of the lower portions of the restrict portions and the front portion of the engaging portion are located at a same horizontal level. The front housing piece 2 defines a slot 270 recessed at the lower surface 27 and three through holes 271 penetrating through a wall of the slot 270 in the vertical direction.

The printed circuit board 3 comprises a mating end 31, a rear end 32 opposite to the mating end 31 and an intermediate portion 33 connecting the mating end 31 with the rear end 32. A plurality of first conductive pads 311 are arranged on opposite upper and lower surfaces of the mating end 31 of the printed circuit board 3. A plurality of second conductive pads 331 are arranged on opposite upper and lower surfaces adjacent to the intermediate portion 33 of the printed circuit board 3 for electrically connecting with conductors of a cable. Triple holes 332 are disposed between the first and second conductive pads 311, 331 and aligned with through holes 271 of the front housing piece 2. Each side edge of the printed circuit board 3 defines a pair of semi-circular positioning holes 333 arranged along the front-back direction.

Referring to FIGS. 1 and 2, the locking member 5 is stamped and formed from a metallic plate and comprises a retaining portion 50 retained in the groove 250 of the engaging portion 25, a locking portion 51 located above and connecting with the retaining portion 25 by two linking portions 52 and a pressing portion 53 rearward and upwardly extending from the locking portion 51. The locking portion 51 is substantially parallel to the retaining portion 50. The locking portion 51 is substantially located at a same plane parallel to the retaining portion 50. Each linking portion 52 is configured as a U-shape. The locking portion 51 comprises a pair of elastic tabs 510 extending vertically upwardly from two sides thereof as shown in FIG. 3.

Figure 3:
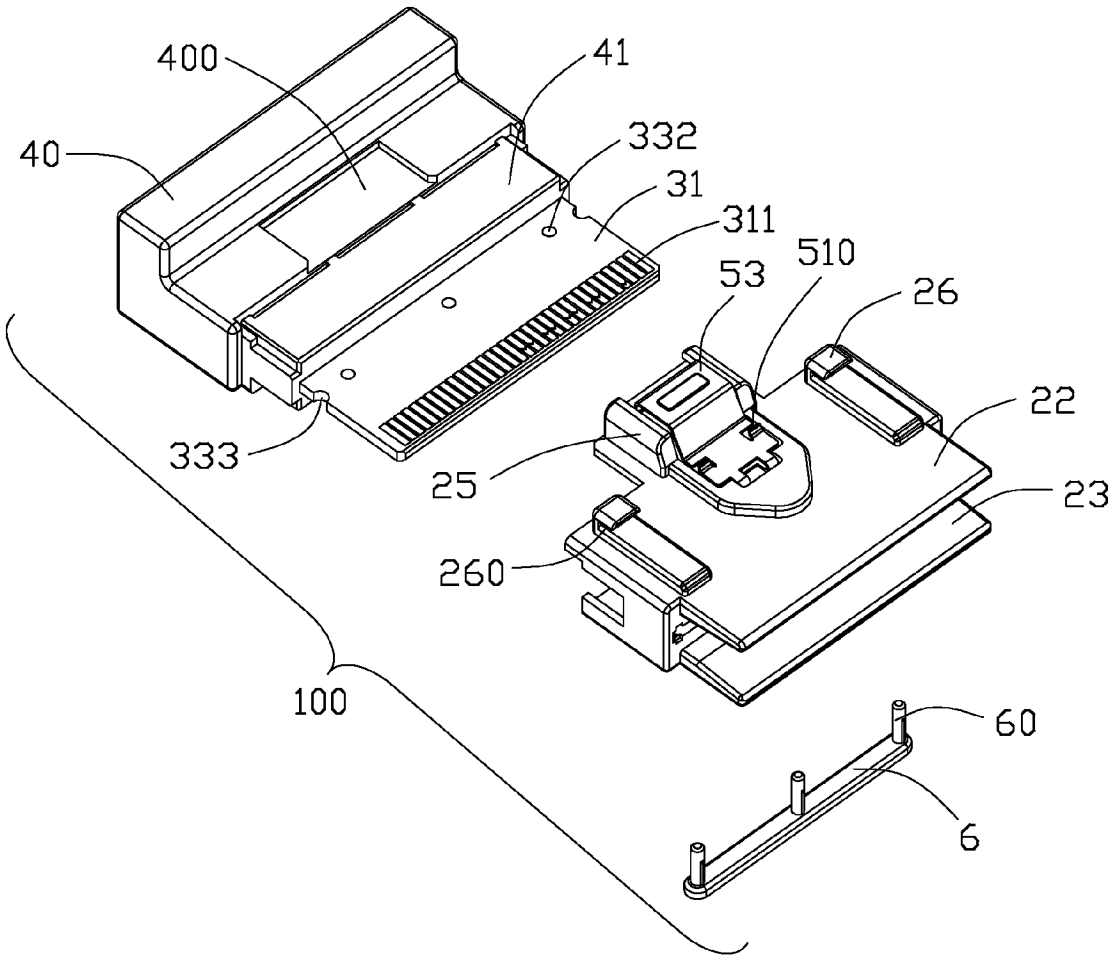
FIG. 3 is a partially assembled view of FIG. 1.
Figure 4:
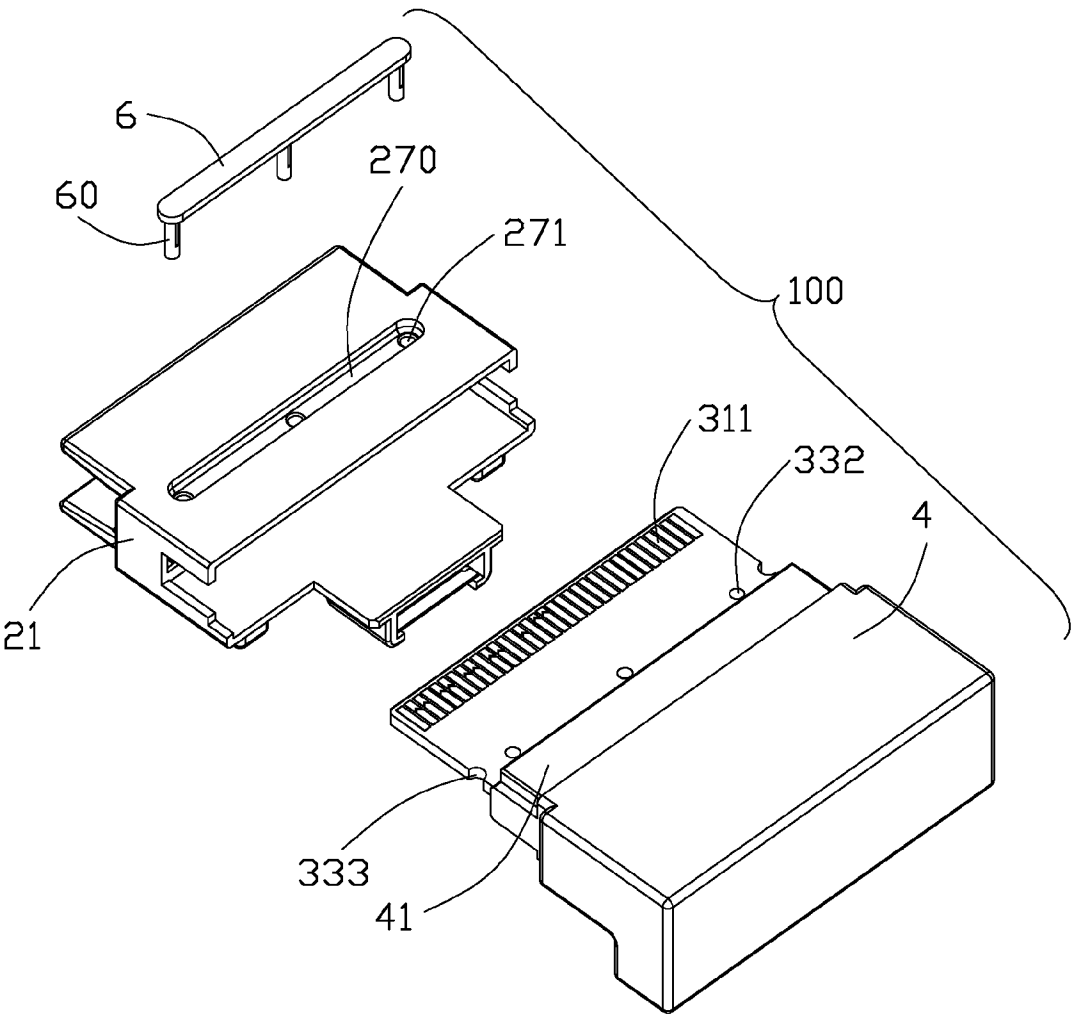
FIG. 4 is a partially assembled view of FIG. 2.

Referring to FIGS. 1 and 2 in conjunction with FIGS. 3 and 4, the rear housing piece 4 comprises a main portion 40 and a holding portion 41 forwardly projecting from the main portion 40. The main portion 40 defines a recess 400 formed in a top front surface thereof so as to receive a rear portion of the engaging portion 25 of the front housing piece 2. The rear surface of the front housing piece 2 abuts against a front surface of the rear housing piece 4.

The front housing piece 2 is assembled with the rear housing piece 4 and encloses a part of the printed circuit board 3. The front housing piece 2 defines a receiving slot therethrough to permit the mating end 31 of the printed circuit board 3 protruding through and parallel to the first and second tongue portions 22, 23 for electrically connecting with a complementary connector 700.

Figure 5:
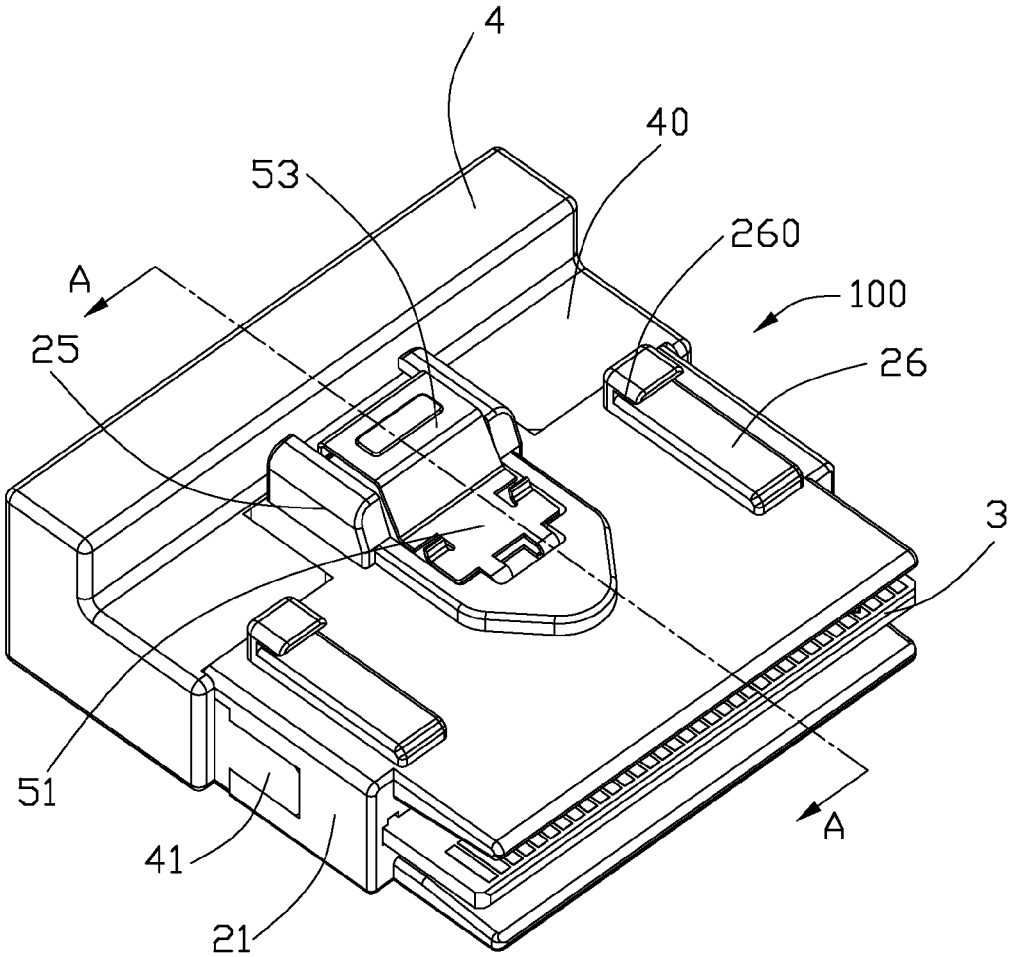
FIG. 5 is a perspective, assembled view of FIG. 1.
Figure 6:
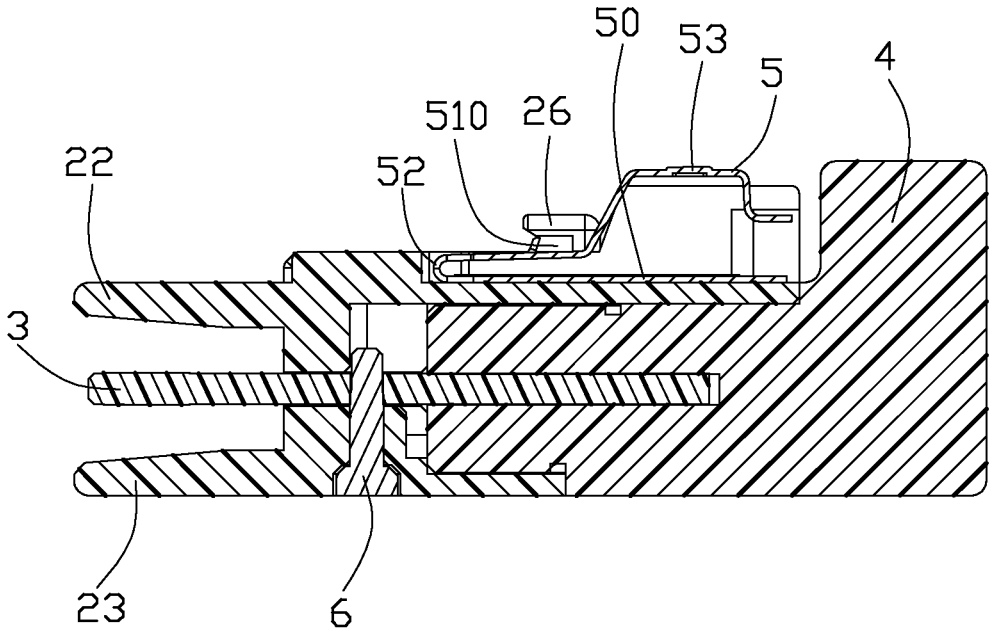
FIG. 6 is a cross-sectional view of the cable assembly taken along a line VI-VI.

Referring to FIGS. 1 and 2 in conjunction with FIGS. 3 to 7, in assembly, firstly the second housing piece 4 is over molded around the rear end 32 of the printed circuit board 3 with the second conductive pads 331 connecting with a plurality of wires. Secondly, the locking member 5 is assembled to the engaging portion 25 of the front housing piece 2, and the retaining portion 50 abuts against the engaging surface 250. Thirdly, the first housing piece 2 with the locking member 5 is assembled to the second housing piece 4 with the printed circuit board 3 so that the mating end 31 is located between the first tongue portions 22 and the second tongue portions 23. The width of the printed circuit board 3 is larger than that of the two tongue portions 22, 23 as shown in FIG. 5, all are smaller than the body portion 21. The holding portion 41 of the rear housing piece 4 is inserted into a receiving room formed in a rear surface of the front housing piece 2 so that a front surface of the main portion 40 closely abuts against the rear surface of the front housing piece 2. In the meantime, the rear part of the engaging portion 25 is received in the recess 400. Further, the holes 332 are aligned with the corresponding through holes 271 of the front housing piece 2 in the vertical direction. Finally, a positioning member 6 having three positioning posts 60 is assembled to the slot 270 of the lower surface 27 of the front housing piece 2, and the positioning posts 60 penetrate through the holes 332 and the through holes 271. Thus, the assembling of the connector cable assembly 100 is finished.

Figure 7:
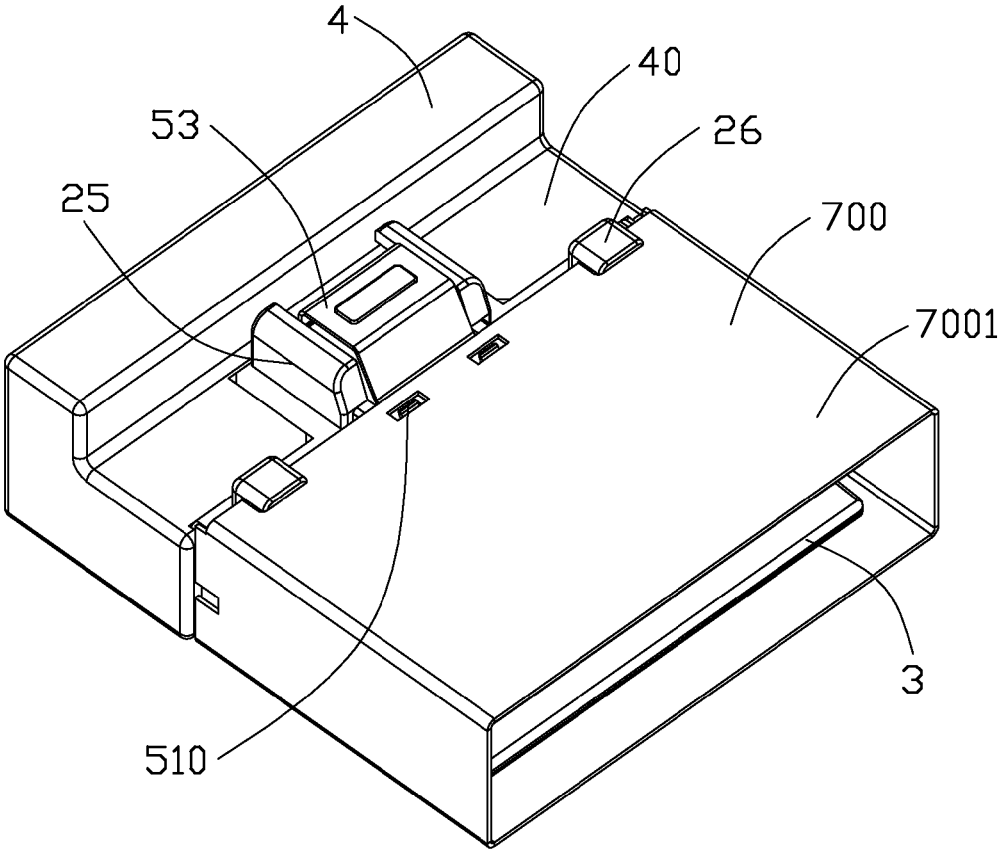
FIG. 7 is a perspective view of the cable assembly engaging with a complementary connector.

Referring to FIG. 7, a complementary connector 700 comprises a shell 7001. When the cable connector assembly 100 mates with the complementary connector 700, the shell 7001 is limited within the receiving groove 260 of the restricting portion 26, which will ensure the engagement of the two connectors from rocking.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a complementary connector, comprising:

a printed circuit board comprising a mating end formed with a plurality of first conductive pads and an opposite rear end formed with a plurality of second conductive pads electrically connecting with conductors of a cable;

a rear housing piece over-molded around the rear end of the printed circuit board;

a front housing piece assembled with the rear housing piece and enclosing a part of the printed circuit board, the front housing piece defining a receiving slot therethrough to permit the mating end of the printed circuit board running through for electrically connecting with the complementary connector and an engaging portion upwardly protruding from a upper surface thereof;

a locking member assembled to the engaging portion of the front housing piece; wherein the front housing piece further has two restricting portions extending upwardly from the upper surface thereof, each restricting portion has a supporting portion, an extension portion forwardly extending from a rear end of the supporting portion and spaced from the supporting portion so that a receiving groove is formed between the supporting portion and the extension portion.

2. The cable connector assembly as claimed in claim 1, wherein the cable connector assembly comprises a holding portion formed on one of front housing piece and the rear housing piece, and a recess in one of the rear housing piece and the front housing piece to receive the holding portion.

3. The cable connector assembly as claimed in claim 1, a positioning member is assembled to the front housing piece and has at least one positioning post penetrating through a bottom surface of the front housing piece and the printed circuit board.

4. The cable connector assembly as claimed in claim 1, wherein the engaging portion comprises a part that extends beyond a rear surface of the front housing piece, the rear housing piece defines a recess to receive the part of the engaging portion and a front surface of the rear housing piece abuts against the rear surface of the front housing piece.

5. The cable connector assembly as claimed in claim 1, wherein the engaging portion defines a groove for retaining the locking member.

6. The cable connector assembly as claimed in claim 5, wherein the locking member comprises a retaining portion retained in the groove of the engaging portion, a locking portion located above the retaining portion, two linking portions connecting the retaining portion with the locking portions and a pressing portion rearward and upwardly extending from the locking portion, the locking portion comprises a pair of elastic tabs extending upwardly from two sides thereof.

7. The cable connector assembly as claimed in claim 1, wherein the front housing piece comprises a body portion, first and second tongue portions respectively extending forwardly from a front face of the body portion, the mating end of the printed circuit board is located between the two tongue portions.

8. A cable connector comprising:

an insulating housing comprising a pair of parallel tongue sections and a printed circuit board located between said two tongue portions with conductive pads;

the insulating housing defines an engaging portion located at an upper surface thereof, the engaging portion defines a supporting surface and a groove;

a locking member retained in the groove;

wherein the insulating housing further defines restrict portions at sides of the engaging portions, the restrict portion defines a lower portion with a top face in a same plane with the supporting surface of the engaging portion and an upper portion spaced from the lower portion.

9. The cable connector assembly as claimed in claim 8, wherein the locking member comprises a retaining portion retained in the groove of the engaging portion, a locking portion located above and connecting with the retaining portion by a linking portion and a pressing portion rearward and upwardly extending from the locking portion, the locking portion comprises a pair of elastic tabs extending upwardly from two sides thereof.

* * * * *